US006077392A

United States Patent [19]

Ruch

[11] Patent Number: 6,077,392

[45] Date of Patent: Jun. 20, 2000

[54] TEXT AND COVER PRINTING PAPER AND PROCESS FOR MAKING THE SAME

[75] Inventor: Thomas D. Ruch, Gansevoort, N.Y.

[73] Assignee: Mohawk Paper Mills, Inc., Cohoes, N.Y.

[21] Appl. No.: 08/963,349

[22] Filed: Nov. 3, 1997

Related U.S. Application Data

[60] Division of application No. 08/723,852, Sep. 30, 1996, Pat. No. 5,902,453, which is a continuation-in-part of application No. 08/593,155, Feb. 1, 1996, abandoned

[60] Provisional application No. 60/004,511, Sep. 29, 1995.

[51] Int. Cl.[7] ..... D21H 19/42

[52] U.S. Cl. ..... 162/135; 162/168.1; 162/169; 162/162; 106/206.1; 106/409; 106/493; 106/501.1; 427/326; 427/395; 428/195; 428/211; 428/219; 428/220

[58] Field of Search ..... 162/100, 135, 162/184, 185, 181.1, 186, 169, 168.1, 162; 428/195, 211, 219, 220; 427/326, 395; 106/206.1, 409, 493, 501.1

[56] References Cited

U.S. PATENT DOCUMENTS

| | | | |
|---|---|---|---|
| 3,146,159 | 8/1964 | Muggleton | 162/184 |
| 3,816,169 | 6/1974 | Vassiliades et al. | 427/395 |
| 3,822,181 | 7/1974 | Vassiliades et al. | 162/162 |
| 3,919,110 | 11/1975 | Vassiliades et al. | 252/316 |
| 3,941,634 | 3/1976 | Nisser et al. | 156/79 |
| 4,064,304 | 12/1977 | Fujita et al. | 162/135 |
| 4,111,713 | 9/1978 | Beck et al. | 428/331 |
| 4,115,187 | 9/1978 | Davidson | 162/168.3 |
| 4,282,060 | 8/1981 | Maslanka et al. | 162/162 |
| 4,427,836 | 1/1984 | Kowalski et al. | 525/301 |
| 4,469,825 | 9/1984 | Kowalski et al. | 523/201 |
| 4,483,889 | 11/1984 | Andersson | 427/389.1 |
| 4,486,523 | 12/1984 | Hosfeld et al. | 430/106.6 |
| 4,529,465 | 7/1985 | DeWitt et al. | 156/277 |
| 4,594,363 | 6/1986 | Blankenship et al. | 521/64 |
| 4,771,079 | 9/1988 | Melber | 521/54 |
| 4,829,102 | 5/1989 | Biale | 523/201 |
| 4,837,200 | 6/1989 | Kondo et al. | 503/227 |
| 4,885,320 | 12/1989 | Biale | 525/317 |
| 4,888,241 | 12/1989 | Melber et al. | 428/407 |
| 4,900,620 | 2/1990 | Tokita et al. | 428/330 |
| 4,912,139 | 3/1990 | Melber et al. | 521/54 |
| 4,925,827 | 5/1990 | Goto et al. | 503/207 |
| 4,929,590 | 5/1990 | Maruta et al. | 503/207 |
| 5,011,862 | 4/1991 | Melber et al. | 521/54 |
| 5,026,782 | 6/1991 | Biale | 525/317 |
| 5,032,225 | 7/1991 | Saji et al. | 162/135 |
| 5,051,279 | 9/1991 | Murata et al. | 427/158 |
| 5,061,677 | 10/1991 | Yoshida et al. | 503/226 |
| 5,071,823 | 12/1991 | Matsushita et al. | 503/227 |
| 5,162,289 | 11/1992 | Betts et al. | 503/226 |
| 5,169,715 | 12/1992 | Maubert et al. | 428/331 |
| 5,182,157 | 1/1993 | Fitch | 428/137 |
| 5,231,068 | 7/1993 | Miyamoto et al. | 503/200 |
| 5,302,575 | 4/1994 | Nogawa et al. | 503/227 |
| 5,314,753 | 5/1994 | Bergmann | 428/511 |
| 5,342,649 | 8/1994 | Sarokin | 427/150 |
| 5,344,487 | 9/1994 | Whalen-Shaw | 106/416 |
| 5,360,657 | 11/1994 | Kano et al. | 428/207 |
| 5,378,534 | 1/1995 | Kuroanagi et al. | 428/327 |
| 5,380,694 | 1/1995 | Krebs | 503/214 |
| 5,569,529 | 10/1996 | Becker et al. | 428/331 |

OTHER PUBLICATIONS

"Recent Developments in Papermaker's Starches", Paper Industry, Feb. 1965, p. 60 and 61.

*Primary Examiner*—Peter Chin
*Attorney, Agent, or Firm*—White & Case LLP

[57] ABSTRACT

A printing paper is provided having the appearance of uncoated paper and improved printability properties approaching those of coated papers. Also provided are a surface treatment formulation having a variable viscosity and a method for producing a printing paper having the appearance of uncoated paper and improved printability properties approaching those of coated papers.

10 Claims, 3 Drawing Sheets

TEXT AND COVER PRINTING PAPER AND PROCESS FOR MAKING THE SAME

CROSS-REFERENCE TO RELATED APPLICATIONS

This application is a divisional of application Ser. No. 08/723,852, filed on Sep. 30, 1996, now U.S. Pat. No. 5,902,453 which is a continuation-in-part of application Ser. No. 08/593,155, filed Feb. 1, 1996 abandoned, which claims priority from U.S. Provisional Application Ser. No. 60/004,511, filed Sep. 29, 1995.

This application is a continuation-in-part of application Ser. No. 08/593,155, filed on Feb. 1, 1996, which claims the benefit, under 35 U.S.C. § 119(e), of U.S. Provisional Patent Application Ser. No. 60/004,511, filed on Sep. 29, 1995.

FIELD OF THE INVENTION

The present invention concerns an improved printing paper which has the appearance of uncoated paper and printability properties approaching those of coated paper, a paper surface treatment formulation, and a method for applying the formulation to produce the improved printing paper.

BACKGROUND OF THE INVENTION

It has been common practice to apply aqueous coatings, consisting of pigments, binders/adhesives, and various functional additives, to paper to produce printing paper. The coatings cover the fibrous paper sheet surface and create an interface for printing inks that is smoother and less absorbent than the uncoated surface.

Prior to coating, the uncoated paper web exhibits many "micro" depressions. The topography of the micro depressions can be seen in FIG. 1. The micro depressions are often the result of open areas between individual fibers and fiber bundles in the paper. The dimensions of these open areas determine the roughness of the paper surface and the amount of coating required to completely fill in the depressions. The micro depressions on the rough sheet surface can vary in depth from as little as 5 microns to as much as 25 microns (1 micron=$1\times10^{-6}$ inch). The average depth of the micro depressions is 10 microns.

The bulk-to-weight ratio of typical coating layers in the prior art is approximately 1.00 micron per lb. of coating of applied, per side, per ream of paper. As used herein a "ream" equals approximately 3,300 $ft^2$ of paper. Application of one lb. of conventional coating per side, per ream of paper will generally result in a layer of coating on the surface of the paper that is 1 micron thick.

FIG. 2 illustrates the topography of a typical paper sheet surface when a coating is applied to the surface by a blade coater, a coater commonly used for applying aqueous coatings for the production of printing paper. To completely fill in the micro depressions on the surface of a paper web, prior art processes will apply 5–25 lbs. of coating per side, per ream of paper web. The amount of coating needed will depend on the formation of the paper web, its absorbent properties, and on the roughness of the particular paper web. For instance, 25 lbs. of coating per side, per ream of paper web may be needed to completely fill in the micro depressions on the surface of a very rough, absorbent paper web.

Although greatly improving print properties, the amount of coating used in coated papers of the prior art significantly alters the appearance of the paper. Coated papers, whether glossy or matte in finish, have an appearance that is much different than that of uncoated premium papers, such as text and cover paper. This difference is considered undesirable by many paper consumers who prefer the appearance of uncoated paper but need the printability properties of coated paper.

Uncoated paper typically can be lightly coated, but the amount of coating is less than 5 lbs. per side, per ream of paper. This lower amount of coating does not alter the desirable uncoated appearance of the paper. However, prior art uncoated papers of this type have never achieved the printability properties of coated paper. Thus, there is great interest in the development of a printing paper which combines the desirable appearance of uncoated paper with the printability properties of coated paper.

Several techniques have been developed in attempts to utilize existing size press equipment to manufacture coated paper. Size presses are typically used in the art to make uncoated paper and are normally used to apply coatings having low viscosities of less than 100 centepoise ("c.p.s.") (Brookfield, 100 r.p.m.). One such technique, known as "film coating" or "wash coating," utilizes existing size press equipment to achieve a slight improvement in the printing paper over uncoated offset paper grades without the capital expense of normal coating treatments. The resulting paper is, however, a lower quality coated paper and often exhibits undesirable characteristics, such as mottle (galvanized gloss) and roll film split pattern.

Another technique involves the use of micro-spherical particle pigment, which has been used to promote gloss and opacity in coated paper. For instance, Kowalski et al. (U.S. Pat. No. 4,427,836) relates to a process for manufacturing water-insoluble, heteropolymer, micro-spherical particles, which may be used as an opacifier or thickener when incorporated in a paint or on aqueous coating.

Vassiliades, et al. (U.S. Pat. No. 3,816,169 and No. 3,822,181) disclose spherical microcapsules that may be used as an opacifier when incorporated in or coated on a paper web. These patents concern the opacifying and/or brightening of the paper web with no regard for printability. The patents do not disclose any specific formulations that could be used to coat the paper. Nor do the patents discuss how such formulations could be applied.

Rohm and Haas Company manufactures Ropaque™, a pigment for use on paper, which is composed of polymeric, hollow, spherical particles ranging in diameter from 0.3–1.0 micron. These particles enhance printability of paper and have a high bulking capability. The particles may be combined with typical binders, such as starch binders, and other ingredients, to create coatings having a greater thickness at a lower weight than typical coatings. When these coatings are applied at low viscosity (less than 100 c.p.s., Brookfield, 100 r.p.m.) using the "wash" or "film" coating techniques described above, the resultant paper exhibits a marginal improvement in printability and opacity.

SUMMARY OF THE INVENTION

The invention provides a printing paper that has the appearance of uncoated paper but surprisingly has the improved printability properties approaching those of conventionally coated papers, which result from the application of 5–25 lbs. of coating per side, per ream of paper. The paper of the present invention achieves printability properties approaching those of conventionally coated papers with the application of a suitable surface formulation at weight levels substantially less than those used in conventional coating methods.

The printing paper of the invention comprises a paper web and a layer of surface formulation applied to and dried on each side of the paper web in an amount of approximately 2–5 lbs. of formulation per side, per ream of paper web. The paper has improved printability properties approaching those of coated paper, yet retains the appearance and desirable characteristics of uncoated paper. Papers of the invention are characterized by an opacity in the range of about 95–100%, an ash content of about 5–25% by weight, a Sheffield smoothness of about 25–250 cc/min., and a Gurley density of about 200–4,000 seconds. These papers also possess the additional characteristics of a brightness of up to about 99%, a stiffness of about 150–4,000 grams, and a K&N drop percentage of about 10–20%. This combination of paper characteristics has never been achieved in a printing paper prior to this invention. A preferred embodiment of the invention relates to text and cover printing papers having the characteristics set forth above.

The papers of the invention have an increased bulk-to-weight ratio of the layer of formulation on the paper surface. The bulk-to-weight ratio of the layer of formulation on paper according to the invention is greater than about 1.15 microns per lb. of formulation applied, per side, per ream of paper web. This bulking characteristic also has never been achieved in a printing papers prior to the invention.

The improved characteristics of the paper of the invention are achieved through the use of a novel surface treatment formulation which is applied to the surface of the paper web. The formulation comprises a pigment composed of hollow particles, and a high molecular weight modified starch binder exhibiting suitable Theological properties.

The hollow particle pigment promotes printability properties in the paper. In addition, the pigment affords increased bulk of the formulation dried on the paper surface with minimum weight application of formulation. In a preferred embodiment of the invention, the hollow particles are spherical and constructed of a synthetic polymer.

The binder is typically a high molecular weight modified starch having optimal Theological properties that make it suitable for application in the methods of the invention. "Modified" starch binders are starch binders that have been altered chemically to control their molecular weight and/or chemical structure, hence changing their viscosity characteristics after cooking. A number of methods of modifying starch and the molecular weights of modified starches are well known in the art.

It has been found that modified high molecular weight starch binders are particularly useful, because the Theological properties of the binder, when combined with the pigment, provide the formulation with a variable viscosity, which is low enough so that the formulation flows as a liquid when agitated, but which increases quickly when the formulation is not agitated or when it is cooled. In preferred embodiments, the binder is a high molecular weight modified cationic potato starch binder. As is common in the art, the skilled artisan may also add other additives to the formulation, such as print aids, anti-scuffing agents, sizing agents and defoamers to achieve various properties.

When agitated, the surface treatment formulation of the invention typically has an initial viscosity of approximately 2,000–4,000 c.p.s. (Brookfield, 100 r.p.m.), preferably 3,000 c.p.s. (Brookfield, 100 r.p.m.). In this range, the formulation is quite thick, appearing similar to a batter, but it will flow as a liquid, and can be pumped through the plumbing of typical coating machines. The formulation is supplied to a coating applicator when it is in this viscosity range. The applicator applies a layer of formulation on the surface of a paper web.

Upon application of the formulation to the paper web, the initial viscosity level of the formulation prevents the formulation from soaking or de-watering into the paper web. In addition, the viscosity of the formulation quickly increases upon application, to further inhibit the formulation from soaking or de-watering into the paper web. The formulation may also be cooled prior to being applied to the paper web surface to further quicken the increase in viscosity and hence further inhibit the formulation from soaking or de-watering into the web. Through these properties of the formulation, a maximum amount of formulation will remain on the surface of the paper after application. In a preferred embodiment, the viscosity of the formulation applied on the surface of the paper web will increase rapidly to greater than 8,000 c.p.s., and even more preferably to greater than 10,000 c.p.s. (Brookfield, 100 r.p.m.).

The maximization of the formulation on the paper surface increases the ultimate bulk-to-weight ratio of the formulation layer when it dries on the surface. Thus, the bulk-to-weight ratio of formulation layer on the surface of the paper according to the invention is higher than the bulk-to-weight ratio of coating layers in the prior art. The layer of formulation in the present invention has a bulk-to-weight ratio of greater than about 1.15 micron per lb. of formulation applied per side, per ream of paper. The preferred bulk-to-weight ratio of the formulation layer is about 1.40 micron per lb. of formulation per side, per ream.

The formulation is preferably applied to each side of the paper web by a contour type metering applicator, such as a high speed metering applicator, roll coater, etc., in a substantially uniform thickness over the topography of the paper surface. This application process minimizes the amount of formulation needed to completely cover the surface of the paper regardless of the roughness of the surface, and aids in achieving the desired printability properties. The formulation of the instant invention may be applied in much lower amounts than typical coatings. The preferable amount of formulation is about 2–5 lbs. per side, per ream of paper. This amount of formulation improves print results substantially without significantly altering the uncoated appearance of the paper.

The paper prepared using the formulations and methods of the invention has increased lithographic ink efficiency (increased density of color with less ink applied), improved print sharpness (less % dot gain), improved ink gloss, and decreased ink show-through, yet the paper has an uncoated appearance. The resultant paper is also improved in that it is stiffer than typical uncoated text and cover papers. Finally, in its calendered state, the resultant paper offers optimum print results from current digital print technology due to its superior smoothness compared to prior art uncoated papers.

DETAILED DESCRIPTION OF THE INVENTION

Figure 1:
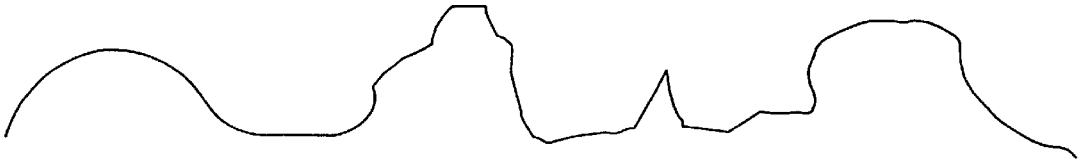
FIG. 1 is a cross-section of the typical surface of a paper sheet and illustrates the many irregular depressions which can be present and which can result in paper roughness.
Figure 2:
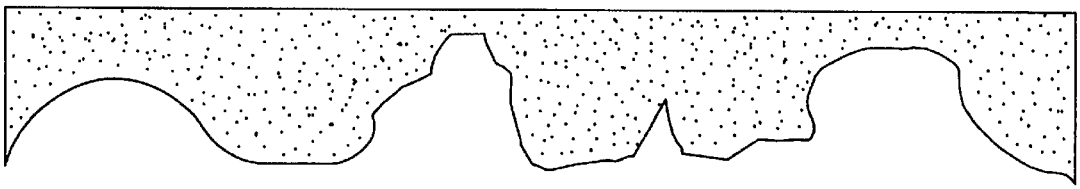
FIG. 2 is a cross-section of the paper surface shown in FIG. 1 with a coating applied by a blade coating applicator.

The invention concerns surface treated printing paper, and in particular text and cover printing papers, which have the appearance of uncoated paper but improved printability properties approaching those of coated papers. The papers of the present invention differ noticeably from prior art conventionally coated printing papers in the amount of surface coating applied to the paper. The prior art coated papers typically have 5–25 lbs. of coating applied per side, per ream of paper in order to achieve acceptable printability properties desired by the industry. By contrast, the papers of the present invention achieve the same desirable printability properties with the application of lower amounts of a formulation applied at about 2–5 lbs. per side, per ream, regardless of the ultimate basis weight of the paper. Due to the viscosity characteristics of the surface formulation of the invention, a smaller amount of surface formulation may be applied, regardless of the variation in the ultimate basis weight of the paper. The present invention also results in a consistently more uniform and thicker layer of formulation on the paper even though smaller amounts are applied.

The printing paper of the invention thus comprises a paper web and a layer of surface formulation disposed on each side of the paper web in an amount of approximately 2–5 lbs. of formulation per side, per ream of paper web. The paper has improved printability properties approaching those of coated paper, yet retains the desirable appearance of uncoated paper. Papers of the invention having a basis weight in the text and cover range of 60–183 lbs. are characterized by an opacity in the range of about 95–100% (measured according to TAPPI test procedure T425-OM-91), an ash content of about 5–25% by weight (measured according to TAPPI test procedure T413-OM-93), a Sheffield smoothness of about 25–250 cc/min. (measured according to TAPPI test procedure T538-OM-88), and a Gurley density of about 200–4,000 seconds (measured according to TAPPI test procedure T460-OM-88). The papers of the invention also exhibit a brightness of up to about 99% (measured according to TAPPI test procedure T452-OM-92), a stiffness of about 150–4,000 grams (measured according to TAPPI test procedure T543-OM-94), and a K&N drop percentage of about 10–20% (measured according to TAPPI test procedure UM-595). This combination of paper characteristics has never been achieved in a printing paper prior to this invention. A preferred embodiment of the invention relates to text and cover printing papers having the characteristics set forth above.

The invention also concerns paper surface treatment formulations and processes for producing printing papers having the appearance of uncoated paper and improved printability properties approaching those of coated paper.

The preferred surface treatment formulation comprises a pigment composed of hollow particles, and a high molecular weight modified starch binder in an aqueous base. The pigment may be present in the range of about 30–60% by weight of the total dry ingredients with the modified starch binder present at about 40–70% of the total dry ingredients. The amount of pigment and binder selected for a particular application will depend on a number of factors that can be appreciated by those skilled in the art. For instance, one skilled in the art will appreciate that a particularly strong binder will be needed if a high percentage of pigment is used. The amounts of pigment and binder may also be decreased so that additives such as print aids, anti-scuff compositions, sizing agents and defoamers may be incorporated into the formulation.

The components of the formulation are mixed and formulated with water into an aqueous composition of solids in the range of approximately 10–30%. The preferred percent of solids is about 20%.

The viscosity of the final aqueous surface treatment formulation is in the range of 2,000–4,000 c.p.s., and is preferably 3,000 c.p.s. (Brookfield, 100 r.p.m.), when agitated at room temperature. Room temperature as used herein refers to the temperatures typically encountered in paper manufacturing mills. The typical temperature range in such mills is about 70–110° F. However, the formulation may also be used outside this temperature range. In the viscosity range of 2,000–4,000 c.p.s., the formulation is relatively thick, appearing similar to a batter, but it will flow as a liquid and may be pumped through the plumbing of typical printing paper manufacturing machines.

When unagitated at room temperature, the formulation will increase in viscosity, preferably to greater than 8,000 c.p.s., and more preferably to greater than 10,000 c.p.s. (Brookfield, 100 r.p.m.). This increase in viscosity further inhibits the formulation, which initially is quite thick, from soaking into the paper web surface.

Figure 5:
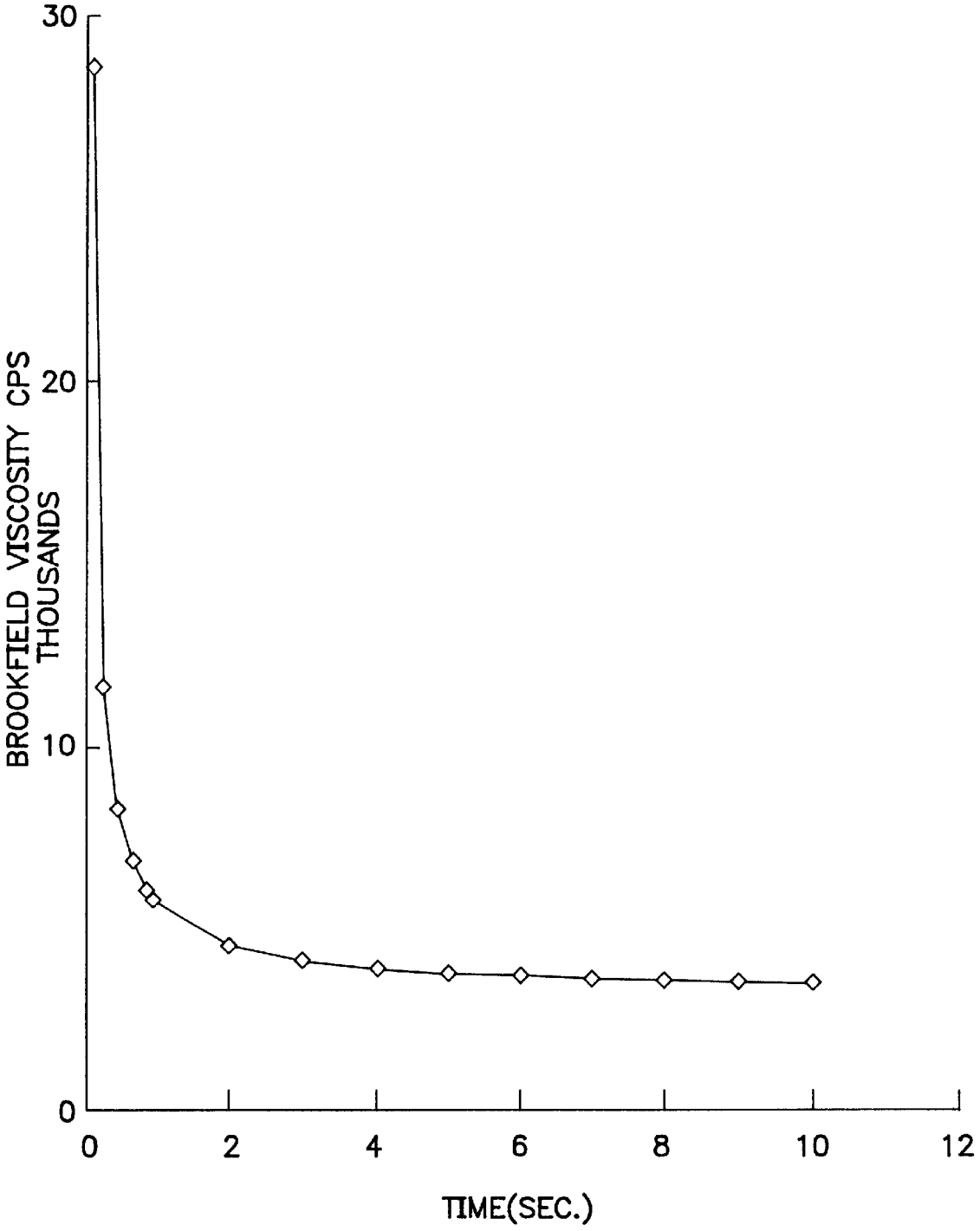
FIG. 5 is a graph of the viscosity characteristics of a formulation according to the present invention.

FIG. 5 is a graph of the change in viscosity of the formulation (measured in Brookfield c.p.s. at 110° F.) when initially at rest and then subjected to a constant agitation. Within the first second of agitation the formulation quickly decreases in viscosity from greater than 10,000 c.p.s. to approximately 3,000 c.p.s. whereupon it maintains a constant viscosity. Although not shown in the figure, the reverse principle is true. That is, when the liquid formulation stored in an agitated container is applied to a paper surface and left stationary on that surface, the viscosity of the formulation will increase from 3,000 c.p.s. to greater than 10,000 c.p.s. very quickly. The rate of increase in viscosity can be enhanced if the formulation is cooled as it is applied to the surface. Any binder which imparts Theological properties to the formulation similar to those shown in FIG. 5 may be used.

The hollow pigment used in the formulation is preferably a synthetic pigment, such as a plastic hollow particle, and most preferably a spherical hollow synthetic pigment particle having an outer diameter of greater than 0.3 micron. Synthetic pigments manufactured by Rohm & Haas, Inc. and sold under the tradename Ropaque™ are particularly suitable in the inventive formulation; however, any other hollow pigment particle with similar properties may be used.

The high molecular weight modified starch binder must impart desirable Theological properties to the aqueous surface treatment formulation. At room temperature, the surface formulation must have a viscosity when it is agitated of about 2,000–4,000 c.p.s. (Brookfield, 100 r.p.m.), and the viscosity preferably rapidly increases upon standing and/or cooling. Any high molecular weight cationic starch binder exhibiting these rheological properties when formulated into an aqueous formulation containing approximately 10–30% solids is suitable for use in the present invention. Modified high molecular weight starch binders that are cationic are preferred, and high molecular weight modified potato cationic starches are most preferred. It has been found that high molecular weight modified cationic potato starch binders sold by Western Polymer Corporation, Moses Lake, Wash. under the tradename Westec are suitable for use in the invention. Specifically, modified starches sold under the names Westec 18, 19, and 20 are preferred and modified starch called Westec 21 is most preferred.

Binders according to the invention, when combined with the hollow spherical particle pigment, provide the formulation with a viscosity that ranges from 2,000–4,000 c.p.s. (Brookfield, 100 r.p.m.) when agitated at room temperature, but which increase rapidly to greater than 8,000 c.p.s., and preferably 10,000 c.p.s. (Brookfield, 100 r.p.m.), when unagitated. Print aids, sizing agents, anti-scuff compounds and other additions may also be incorporated into the formulation, as desired.

Figure 6:
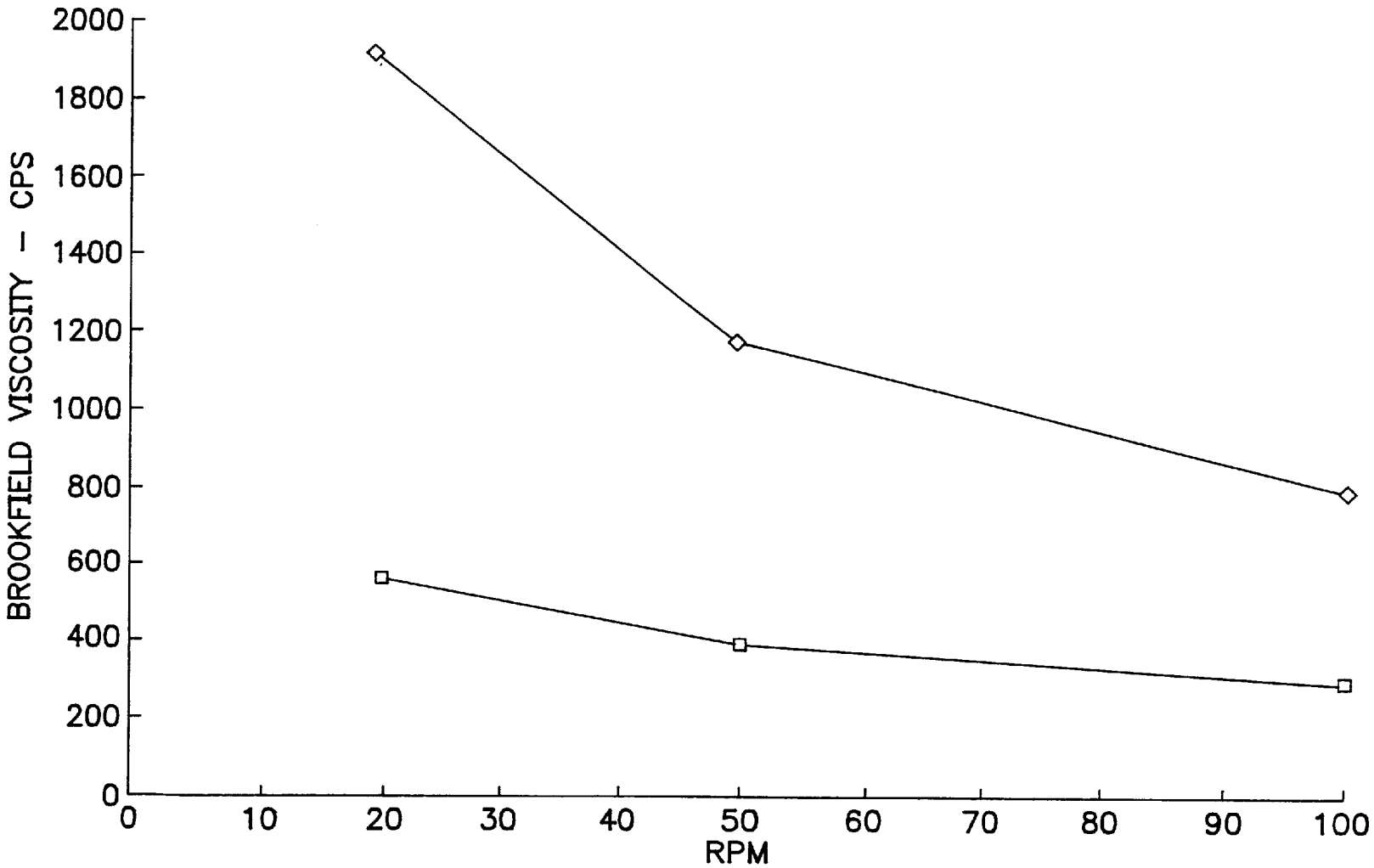
FIG. 6 is a graph of the viscosity characteristics of a binder used in the formulation according to the present invention.

FIG. 6 is a graph of the viscosity characteristics of the preferred high molecular weight modified potato cationic starch binder, Westec 21. For the binder at 10.3% solids content, and two temperatures of 100° F. and 125° F., the graph shows the viscosity of the binder over the range of 20–100 r.p.m. At 100 r.p.m., the viscosity of the binder is approximately 800 c.p.s. at 100° F., and 300 c.p.s. at 125° F. Starch binders which exhibit these characteristics and which, when combined with the pigment, yield a formulation having the viscosity characteristics described above and shown in FIG. 5, are suitable for use in the invention.

A preferred embodiment of the formulation is as follows:

| | Percentage of Total Dry |
|---|---|
| Synthetic Pigment: Ropaque ® HP-1055 | 38% |
| Print Aid: Aluminum Trihydrate | 10% |
| Binder: Westec 21 (Starch) | 48% |
| Anti-Scuff: Imsil A-8 | 2% |
| Sizing Agent: Sequapel 409 | 1% |
| Defoamer: Generic | ≦1% |

Finished Formulation Specification

Solids: 10–30%

Water: to achieve targeted percentage of solids

Viscosity: 2,000–4,000 c.p.s. (Brookfield, 100 r.p.m.)

Ph: 7.5

The formulation is prepared by batch or jet (continuous) cooking a modified cationic potato starch binder, such as Westec series binder, at a solids level that is compatible with the system being used. After cooking, the binder is mixed with the additional components in a high shear coating mixer, allowing for adequate mixing time to achieve homogeneity.

The pigment, which is composed of hollow, spherical, particles, serves as an opacifier and a vehicle for ink hold-out in the formulation. Ropaque™ HP-1055, manufactured by Rohm and Haas, is a preferred pigment. Other pigments, such Ropaque™ HP-433, HP-91 and OP-84, may also be used.

The aluminum trihydrate is a print aid and a pigment extender which may be used with the more expensive pigment. Imsil A-8 is added to "toughen" the treated paper surface and lessen the tendency to "work or scuff." The sizing agent, Sequapel 409, minimizes the wettability of the surface when the paper is being printed by lithography. The defoamer is added to lessen the foaming tendency during preparation and application of the formulation. Water is added to adjust the solution so that it contains the desired percentage of solids.

The percentage of solids controls the overall weight of the dried formulation on the paper surface and also controls the viscosity of the formulation. The percentage of solids is critical to the ability to apply the desired amount of inventive formulation and to the achievement of the optimum viscosity required.

The hollow, spherical-particle pigment is most preferably present in the formulation in a range from about 30–60% by weight of the total dry ingredients. The binder is most preferably present in a range from about 40–70% by weight of the total dry ingredients. The percentages of the remaining ingredients may be adjusted accordingly in light of these ranges. The subject invention affords facile application of formulation with the high ratio of pigment (hollow, spherical-particle pigment+print aid) to binder of 1:1, and this ratio is present in the preferred embodiments of the invention.

The formulation is designed to afford uniform coating of maximum thickness with a minimum weight applied to the paper surface and to afford minimal penetration of the formulation below the surface of the paper. This is accomplished by the combination of the following factors:

- The ingredients in combination yield a formulation having a high bulk-to-weight ratio (high specific volume) when compared to typical paper coatings;
- The rheology of the formulation is such that when it is applied, it resists soaking or de-watering into the base sheet; and
- The cationic binder promotes an accelerated immobilization of the formulation on the paper surface.

At 10–30% solids, the formulation has a viscosity of 2,000–4,000 c.p.s. while it is being held in an agitated storage container, awaiting application. If the coating formulation is left unagitated, its viscosity will increase exponentially within seconds to a viscosity of greater than 8,000 c.p.s. and preferably greater than 10,000 c.p.s. (Brookfield, 100 r.p.m). This process is reversible and the viscosity will return to 3,000 c.p.s. upon re-agitation of the batch. This characteristic of the formulation is shown in FIG. 5, which is discussed above.

Utilization of a cationic binder gives the formulation a positive electrical charge. Due to the nature of the papermaking process and the raw materials, the paper to be treated typically has a negative electrical charge. Thus, when the positively charged (cationic) formulation is applied to the negatively charged paper, an interpolymeric complex, which prevents the structure from collapsing upon drying, is formed on the paper surface. This causes the formulation to immobilize on the paper surface quicker than conventional (anionic) coatings, resulting in less penetration of formulation into the surface and improved coverage (via increased coating bulk).

The paper web will of course be a parameter in any method used to construct printing paper. In the preferred embodiment of the invention, the paper web has excellent formation characteristics. "Formation" describes the relative uniformity of fiber dispersion in the paper web.

Several techniques for evaluating paper web formation are well known in the art. One technique involves the use of an on-line formation sensor, manufactured as "F-Sensor" by NDC Systems, Juliet, Tenn., which identifies the quality of the web formation by reference to a scale ranging from 0 to 1,000, where "0" represents a perfectly formed web. Paper webs for use in the present invention are extremely well-formed and exhibit F-Sensor values of 25–30.

The invention also concerns a method of producing coated papers with the surface treatment formulations of the invention. In its essence, the inventive method comprises agitating the formulation so that it is maintained in the initial viscosity range of about 2,000–4,000 c.p.s. (Brookfield, 100 r.p.m.) at room temperature, and applying the formulation to a paper web using a high speed metering contour type applicator. The applicator cools the formulation and meters a uniform film of formulation onto the paper web. A more detailed description of the method follows.

After the formulation ingredients are mixed, the formulation is pumped from the high shear coating mixer to a storage vessel, wherein the formulation is agitated and from which the formulation applicator means is supplied. The storage vessel, which is at room temperature, continuously agitates the formulation to maintain the viscosity of the formulation at 2,000–4,000 c.p.s. (Brookfield, 100 r.p.m.). Thus, the formulation can be applied from the storage vessel to the surface of a paper in a liquid form.

The formulation is applied to the paper web using a high speed metering contour type applicator, such as a Twin High Speed Metering (Twin HSM) applicator manufactured by BTG Ltd. of Saffle, Sweden. The contour type metering applicator will dispose a relatively uniform layer of formulation on the sheet surface and does not alter the topography of the paper surface (cf. FIG. 3). Because of the small amount of formulation applied, it is important that the formulation be applied uniformly to prevent print mottle.

Figure 4:
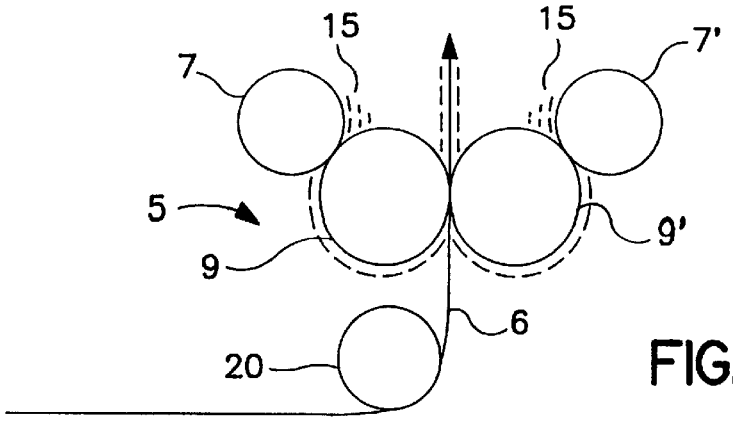
FIG. 4 is a top view of a typical Twin High Speed Metering contour type applicator used in the invention.

A typical Twin HSM applicator system and components thereof are referred to numerically in FIG. 4. The Twin HSM applicator (5) is a four-roll applicator. The applicator (5) generally has two, high-speed, metering rolls (7 and 7') and two corresponding backing rolls (9 and 9'). The formulation (15) is pumped into the nip on each side of the sheet that is formed by the high-speed, metering rolls (7 and 7') and the corresponding backing rolls (9 and 9'). The high-speed, metering rolls (7 and 7'), which rotate at approximately 10% of the surface speed of the backing rolls (9 and 9'), meter a uniform quantity of formulation onto the backing rolls. This metered uniform quantity of formulation is then applied by backing rolls to opposite sides of paper web (6), which is directed between the adjacent backing rolls by a feeder roll (20).

The high-speed, metering rolls (7 and 7') are water cooled to 60° F. and thus cool the formulation as it is metered onto the corresponding backing rolls (9 and 9'). The combination of this cooling effect with the handling of the formulation under non-shearing conditions as it is transported to, applied to, and dried on the sheet, and with the quick immobilization of the cationic formulation on the negatively charged paper surface, allows the formulation to change viscosity from 2,000–4,000 c.p.s. to greater than 10,000 c.p.s. This change in viscosity prevents the formulation from soaking or de-watering into the paper surface and thus encourages optimum hold out of the formulation on the paper surface.

Figure 3:
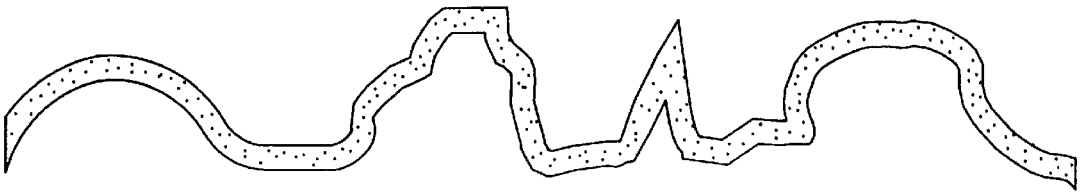
FIG. 3 is a cross-section of the paper surface shown in FIG. 1 with the surface treatment formulation of the invention applied by a contour type applicator.

The Twin HSM applicator is a "contour" type applicator that applies the coating evenly over the entire surface of the paper (see FIG. 3). The use of any contour applicator that is capable of handling the inventive formulation with its unusual flow properties should achieve the desired effect according to the invention. At the level of application contemplated in the instant invention, e.g., 3 lbs., per side, per ream of paper, mottle (non-uniform ink density) would likely result using traditional (non-contour) coating procedures due to the variations in coverage thickness.

The formulation and application method allow the manufacturer to apply enough formulation to the sheet's surface to assure a significant print improvement without altering the visual aspects of the sheet. The amount of formulation required to practice the invention is in the range from about 2–5 lbs. of formulation per side, per ream of paper, with the most preferred amount is about being 3 lbs. per side, per ream. At these levels, the paper, while literally "coated," does not have the appearance of coated paper to the human eye. Application amounts less than these provide diminished print performance while applications of significantly more than these can cause print problems, e.g., mottle and picking off of the coating on the printing press, as well as a coated paper appearance.

The method also provides for the application of an additional conventional coating over the formulation layer. In this method, the formulation is employed as a pretreatment to minimize the amount of conventional coating required to achieve desired printability properties.

The following examples are offered to describe particular embodiments of the invention. However, these are only examples and do not in any way limit the intended, disclosed scope of the invention.

EXAMPLE 1

An uncoated, uncalendered 64-lb. paper web, consisting of a mixture of 30% hardwood, 30% softwood, 20% ash, and 20% post-consumer de-inked fiber, was treated with 3 lbs. of formulation per side, per ream, applied with a Twin HSM contour applicator. The sheet was then dried and calendered to a smooth finish of 70 Sheffield. Similarly, a conventional surface size sheet coated with 1 lb. conventional, size press, starch, per side, was produced. Upon comparing each sheet in a printing study, it was found that the treated sheet performed in a superior manner. This comparison was a visual comparison of sharpness of print, as well as of improved ink density, ink gloss, and reduced half-tone dot gain. When printing both sheets to equivalent ink densities, a 15% reduction in ink usage in the formulation-treated sheet was observed. In addition, the opacity of the formulation-treated sheet was 2% higher (TAPPI OPACITY method T425-OM-91)) than the typical starch-treated sheet.

EXAMPLE 2

An uncoated, 64 lb. paper web with the same composition as Example 1 was treated with 3 lbs. of the formulation per side, per ream, applied with a Twin HSM contour applicator. The sheet was then dried, and calendered to a finish of 30 Sheffield. This smoothness has never been attained with an uncoated paper. This smoothness was attained without the undesirable results of galvanizing, or mottle, which results from over-calendering of paper. This invention thus enables the user to produce ultra smooth, uncoated paper at previous unachievable smoothnesses with moderate calender pressures.

EXAMPLE 3

An uncoated paper sheet, treated with the formulation as described in Example 1 was compared in a print trial to a conventionally (blade) coated sheet with 10 lbs. of coating per side. The results showed that although the ink gloss was not as high for the inventive sheet, the dot gain and print sharpness were similar. Due to the nature of the blade coating procedure, blade coated paper is smoother and would, therefore, be expected to provide a smoother, glossier print image. This experiment did demonstrate, in any event, that the paper produced according to the invention approaches the print performance of conventionally coated paper.

EXAMPLE 4

The formulation and methods of the invention may also be used as a pretreatment in preparing conventional coated papers, thus reducing the amount of conventional coatings which need to be applied to the paper surface.

An uncoated base paper sheet was treated with the formulation as described in Example 1. The resulting sheet was then passed through a blade applicator whereby 6 lb of conventional coating per side was applied. This procedure produced a superior printing sheet with unusually smooth surface characteristics. In addition, the opacity derived from this process was 2% higher (by TAPPI method) than conventional coated paper of equal weight.

COMPARATIVE EXAMPLES

To illustrate the superiority of the instant invention over typical coatings and methods of application, comparative measurements were made of the thickness of a typical coating layer on a coated printing paper and the thickness of the layer of formulation on printing paper prepared according to the invention. From the respective thicknesses and dry weights of the coatings, the respective bulk-to-weight ratios can be calculated and compared. The following tables illustrate the results:

TABLE 1

COMPARISON OF THICKNESS, WEIGHT AND BULK

| | Thickness (Microns) | Weight lbs./3,300 ft.$^2$ | Bulk Microns/lb./ 3,300 ft.$^2$ |
|---|---|---|---|
| Typical Coated Paper (uncalendered) | 19.2 | 19.0 | 1.01 |
| Paper According to the Invention (uncalendered) | 8.2 | 6.0 | 1.37 |

Table 1 shows the total coating thickness and weight for both sides of the paper. The results demonstrate the advantage of the inventive formulation and application process over conventional coatings and application process, achieved with a smaller quantity of coating over conventional coating and application processes. Significantly, in this particular example, a bulk-to-weight ratio of 1.37 micron per lb. of formulation applied per side, per ream was achieved using the formulation of the present invention applying a total of 6.0 lbs. By contrast, the prior art conventionally coated paper achieves a bulk-to-weight ratio of only 1.01 micron per lb. of formulation applied per side, per ream, with application of 19.0 lbs. of conventional coating. Formulations of the invention result in a paper having a coating bulk that is typically greater than or equal to 1.15 microns per lb., per side, per seam, a level that heretofore has not been achieved by prior art coatings used with standard application equipment.

In Tables 2–4, papers according to the present invention were compared to various coated and uncoated papers known in the prior art. The basis weight of the finished papers in these comparisons was 70 lbs.

TABLE 2

COMPARISON OF ASH, OPACITY AND STIFFNESS

| | Ash (% weight) | Opacity (%) | Stiffness (grams) |
|---|---|---|---|
| Typical 70 lb. Matte Coated Free Sheet | 40 | 94 | 160 |
| Typical 70 lb. Uncoated Premium Vellum Sheet | 20 | 94 | 300 |
| Mohawk Superfine 70 lb. Text Vellum Sheet | 24 | 94 | 225 |
| 70 lb. Vellum Paper According to the Invention | 20 | 96.5 | 300 |
| Typical 70 lb. Uncoated Premium Smooth Sheet | 20 | 94 | 300 |
| Mohawk Superfine 70 lb. Text Smooth Sheet | 24 | 94 | 225 |
| 70 lb. Smooth Paper According to the Invention | 20 | 96.S | 300 |

Table 2 shows the ash content, opacity, and stiffness values for papers according to the present invention as compared to papers known in the prior art. As can be seen from the data, the papers according to the invention achieve a high degree of opacity (96.5%) and stiffness (300 grams) at relatively low levels of ash (20% by weight). This combination of properties has not been achieved by any of the prior art papers.

TABLE 3

COMPARISON OF SMOOTHNESS

| | PPS | Sheffield (cc/min.) |
|---|---|---|
| Typical 70 lb. Matte Coated Free Paper | 2.5–3.5 | 25–35 |
| Typical 70 lb. Uncoated Premium Vellum Paper | N.A. | 275–350 |
| Mohawk Superfine 70 lb. Text Vellum Sheet | N.A. | 275–350 |
| 70 lb. Vellum According to the Invention | N.A. | 150–250 |
| Typical 70 lb. Uncoated Premium Smooth Paper | 5.0–6.0 | 100–150 |
| Mohawk Superfine 70 lb. Text Smooth Paper | 5.0–6.0 | 100–120 |
| 70 lb. Smooth Paper According to the Invention | 4.0–5.0 | 60–100 |
| Typical 70 lb. Uncoated Premium Ultra Smooth Paper | 4.0–5.0 | 70–100 |
| 70 lb. Ultra Smooth Paper According to the Invention | 3.0–4.0 | 30–60 |

Table 3 shows the smoothness for papers according to the present invention as compared to papers known in the prior art. This data is the result of a PPS test (which stands for Parker Print Surf) and a Sheffield smoothness test. As shown in this table, papers according to the invention have smoothness values approaching those of coated papers.

TABLE 4

COMPARISON OF PRINT PERFORMANCE PARAMETERS

| | Dot Gain (%) | Black Ink Density | K & N Drop (%) | Gurley Density (seconds) |
|---|---|---|---|---|
| Typical 70 lb. Matte Coated Free Paper | 15 | 1.55 | 5–10 | 3,000–5,000 |
| Typical 70 lb. Uncoated Premium Smooth Paper | 25 | 1.30 | 25–35 | 25–100 |
| Mohawk Superfine 70 lb. Text Smooth | 25 | 1.30 | 25–35 | 25–100 |
| Typical 70 lb. Uncoated | 25 | 1.30 | 25–35 | 25–100 |

TABLE 4-continued

COMPARISON OF PRINT PERFORMANCE PARAMETERS

| | Dot Gain (%) | Black Ink Density | K & N Drop (%) | Gurley Density (seconds) |
|---|---|---|---|---|
| Premium Ultra Smooth Paper | | | | |
| 70 lb. Ultra Smooth Paper According to the Invention | 20 | 1.50 | 10–15 | 1,500–2,500 |

Table 4 shows the print performance parameters of % dot gain, black ink density, K&N Drop, and Gurley Density for papers according to the invention as compared to papers known in the prior art. This table shows that the characteristics of the paper according to the invention approach those of the matte coated free paper, and are far superior to the characteristics of uncoated papers.

The print characteristics listed on the table are defined as follows: Dot gain is the wicking or spreading of ink as it is applied to the paper. Lower % dot gain is preferable in that a sharper image may be created. Black Ink Density refers to the color density as measured by a densitometer. A higher density is preferable as it allows a printer to use less ink to achieve a specific density target. K&N Drop refers to the degree of absorption of ink into a stained area on the paper surface after a specific amount of ink is first applied and then wiped away from the surface. A lower percentage of K&N drop is preferable in that it is an indicator less ink may be applied to reach desired print levels. Gurley Density refers to the time it takes to force a given quantity of air through a given area of paper in seconds. Longer times of Gurley density are preferable as they indicate a tighter paper, which will provide sharper print images.

Tables 5–7 provide data concerning opacity, smoothness, Gurley density, ash content, and brightness for vellum, smooth, and ultra smooth papers of the invention over a range of basis weights from 60–146 lbs.

TABLE 5

VELLUM

| | Basis Weight | | | |
|---|---|---|---|---|
| | 70 lb. | 80 lb. | 116 lb. | 146 lb. |
| Opacity | 96.5 | 97 | 98.5 | 99.5 |
| Smoothness (sheffield) | 200 | 200 | 250 | 250 |
| Gurley density | 250 | 750 | 200 | 200 |
| Ash | 20 | 20 | 16 | 14 |
| Brightness | 92–98 | 92–98 | 92–98 | 92–98 |
| Formation (F-Sensor) | 25–30 | 25–30 | 25–30 | 25–30 |

TABLE 6

SMOOTH

| | Basis Weight | | | |
|---|---|---|---|---|
| | 70 lb. | 80 lb. | 116 lb. | 146 lb. |
| Opacity | 96 | 97 | 98 | 99 |
| Smoothness (sheffield) | 10 | 70 | 70 | 70 |
| Gurley density | 1600 | 1600 | 500 | 370 |
| Ash | 20 | 20 | 16 | 14 |
| Brightness | 92–98 | 92–98 | 92–98 | 92–98 |
| Formation (F-Sensor) | 25–30 | 25–30 | 25–30 | 25–30 |

TABLE 7

ULTRA SMOOTH

| | Basis Weight | | | | | |
|---|---|---|---|---|---|---|
| | 60 lb. | 70 lb. | 80 lb. | 100 lb. | 116 lb. | 146 lb. |
| Opacity | 94 | 95 | 96 | 97 | 97.5 | 98.5 |
| Smoothness (sheffield) | 40 | 40 | 40 | 40 | 40 | 40 |
| Gurley density | 2200 | 2200 | 1400 | 800 | 600 | 500 |
| Ash | 22 | 22 | 20 | 18 | 16 | 14 |
| Brightness | 92–98 | 92–98 | 92–98 | 92–98 | 92–98 | 92–98 |
| Formation (F-Sensor) | 25–30 | 25–30 | 25–30 | 25–30 | 25–30 | 25–30 |

As is shown in Table 5–7, the formulation and method of the invention may be used to create a variety of different styles of paper, all of which have the desirable appearance of uncoated paper and improved printability properties approaching those of coated paper.

What is claimed is:

1. A method for producing a printing paper comprising:

a) providing a formulation comprising:

a pigment comprising hollow spherical synthetic polymeric particles in an amount of about 30–60% by weight of the total dry ingredients of the formulation; and a binder comprising a high molecular weight modified starch in an amount of about 40–70% by weight total dry ingredients of the formulation;

wherein the formulation has a solids content of about 10–30% by weight, the remaining percentage being water; and wherein the formulation has a viscosity that is about 2,000–4,000 c.p.s. (Brookfield 100 r.m.p.) when the formulation is agitated at room temperature and that increases to greater than about 8,000 c.p.s. (Brookfield, 100 r.p.m.) when the formulation is unagitated at room temperature b) agitating the formulation in a storage vessel to maintain the formulation in the decreased viscosity state;

c) metering a uniform layer of the formulation from the storage vessel on each side of an uncoated paper web using a contour type metering applicator, whereupon the formulation increases its viscosity; and d) drying the formulation on the paper web.

2. A method according to claim 1, further comprising cooling the formulation prior to metering the layer of formulation on the paper web.

3. A method according to claim 1, wherein the binder is a modified cationic starch.

4. A method according to claim 3, wherein the binder is derived from potato starch.

5. A method according to claim 3, further comprising providing hollow spherical particles having an outer diameter of greater than about 0.3 micron as the pigment.

6. A method according to claim 5, further comprising providing the pigment and binder in approximately equal amounts in a ratio of approximately 1:1.

7. A method according to claim 6, wherein the solids content provided is about 20% by weight, the remaining percentage being water.

8. A method according to claim 1, further comprising metering the formulation on the paper web in an amount of about 2–5 lbs. per side, per ream of paper web.

9. A method according to claim 1, further comprising applying a layer of coating over the layer of formulation, and drying the coating.

10. A printing paper produced by the method of claim 1.

* * * * *